US006467272B1

(12) United States Patent
Biondo et al.

(10) Patent No.: US 6,467,272 B1
(45) Date of Patent: Oct. 22, 2002

(54) MEANS FOR WEAR REDUCTION IN A GAS TURBINE COMBUSTOR

(75) Inventors: Charles Biondo, Jupiter, FL (US); Frank Hoegler, Painesville, OH (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 09/891,003

(22) Filed: Jun. 25, 2001

(51) Int. Cl.[7] ..... F02C 1/00
(52) U.S. Cl. ..... 60/740; 60/733
(58) Field of Search ..... 60/800, 732, 733, 60/737, 740

(56) References Cited

U.S. PATENT DOCUMENTS 4,982,570 A 1/1991 Waslo et al.
5,199,265 A 4/1993 Borkowicz
5,357,743 A * 10/1994 Zarzalis et al. ..... 60/39.23
5,435,126 A 7/1995 Beaudoin
5,749,218 A 5/1998 Cromer et al.
6,282,904 B1 9/2001 Kraft et al.

OTHER PUBLICATIONS

U.S. patent application Ser. No. 09/664,898, Kraft et al., filed as Pat. No. 6,282,904, Sep. 2001.

* cited by examiner

*Primary Examiner*—Charles G. Freay
(74) *Attorney, Agent, or Firm*—Brian R. Mack; Christopher T. Hayes

(57) ABSTRACT

A wear reduction means for a fuel nozzle interface of an industrial gas turbine combustor is disclosed. The wear reduction means includes a replaceable insert welded into the engagement location of the fuel nozzle tip. The fuel nozzle tip is coated with a material harder than the replaceable insert, such that any wear due to mechanical contact of the mating components is directed to the replaceable insert.

6 Claims, 3 Drawing Sheets

MEANS FOR WEAR REDUCTION IN A GAS TURBINE COMBUSTOR

BACKGROUND OF THE INVENTION

1. Field of the Invention

This invention relates to gas turbine combustors and in particular to low emissions Nitric Oxide (NOx) combustors that incorporate multiple fuel nozzles, including a central fuel nozzle located within a premix swirler assembly. This fuel nozzle arrangement is typically found in a dual stage—dual mode combustor used in industrial gas turbines for generating electricity. Due to manufacturing and assembly tolerances with mating components, as well as movement during operation, wearing of the central fuel nozzle and mating swirler has been known to occur. The components are typically constructed of similar materials and will therefore wear at a similar rate. This wear is due to the mating surfaces interacting with each other, which is in turn due to relative mechanical movement of the surfaces and differing thermal expansion of these surfaces. Excessive wear can lead to premature replacement of these components at significant expense to the engine operator. Replacement costs for a new central fuel nozzle and premix swirler assembly can easily exceed $10,000 per combustor. For a typical industrial gas turbine, this wear condition could require early replacement costs of over $100,000 per engine. Utilizing the present invention can extend the life of both the central fuel nozzle and mating premix swirler by reducing the amount of wear, for each component, and directing what wear does occur to a replaceable insert within the premix swirler. Application of this invention will increase the length of time in between combustor overhauls, extend component life, and there by reduce maintenance costs to the engine. Overhaul costs to the operator for applying this invention to the combustor are approximately $1,600 per combustor, or only $16,000 for a typical industrial gas turbine.

2. Description of Related Art

A typical gas turbine may contain multiple combustors each of which contain at least one fuel nozzle for injecting fuel, gaseous or liquid, into the combustor. This fuel then mixes with air and reacts to form a hot gas mixture that drives a turbine. The turbine is mechanically connected to a drive shaft, which is coupled to a generator for generating electricity. Components of a combustor are constructed of high-grade material with high temperature capability to withstand the harsh operating environment. Despite the high quality material selection, there are multiple components of a combustor that interact, and these components, through frictional contact with each other, will degrade during engine operation, eventually requiring replacement.

U.S. Pat. No. 5,749,218, addresses a similar area of concern for engagement of a fuel nozzle to a "floating" mounting ring of a combustor cap assembly. This mounting ring, composed of a harder material than the fuel nozzle, is allowed to float around the nozzle. Under engine operating conditions the mounting ring vibrates against the fuel nozzle, which is typically made of a softer material, such as stainless steel. This vibration and movement causes excessive wear on the fuel nozzle.

The referenced patent discloses the concept of weld build-up on the fuel nozzle with a material that is sacrificial when it is worn by the corresponding mounting ring. Application of this invention has been known to extend the time between scheduled overhauls by as much as 4,000 operating hours, there by reducing the amount of overhaul operations, and as a result, decreasing the amount of time the engine is offline for repairs. The weld build-up process for this application is advantageous because the fuel nozzle described is relatively small in size, easy to overhaul and repair, and the location of the weld build up is not located close to any critical fuel metering orifices. Misapplication of weld build-up material at such orifices would require excessive rework to the fuel nozzles, and could also reduce performance of the fuel nozzle.

Therefore, although the wear reduction means disclosed in U.S. Pat. No. 5,749,218, is adequate for the embodiment disclosed, it is not advantageous for certain other interfaces, such as a central fuel nozzle that engages a fixed swirler assembly.

What is desired is a wear reduction system that provides the cost benefits of the prior art, but does not have the shortcomings related to weld build-up material in orifices.

SUMMARY AND OBJECTS OF THE INVENTION

It is therefore an object of the present invention to reduce the amount of wear exhibited by a center fuel nozzle in a dual stage-dual mode combustor.

Another object of the invention to direct any wear that does occur to a replaceable insert and reduce the amount of wear exhibited by the fuel nozzle.

Accordingly, the present invention operates in a gas turbine combustor with low nitric oxide emissions, wherein the invention pertains to a means of reducing the amount of wear exhibited between a fuel nozzle and its combustion liner interface. Specifically disclosed is a relationship and structure for directing wear associated with manufacturing and assembly tolerances as well as mechanical interaction to a replaceable insert within in a combustion liner.

In accordance with these and other objects, which will become apparent hereinafter, the instant invention will now be described with particular reference to the accompanying drawings.

DETAILED DESCRIPTION OF THE PREFERRED EMBODIMENT

Figure 1:
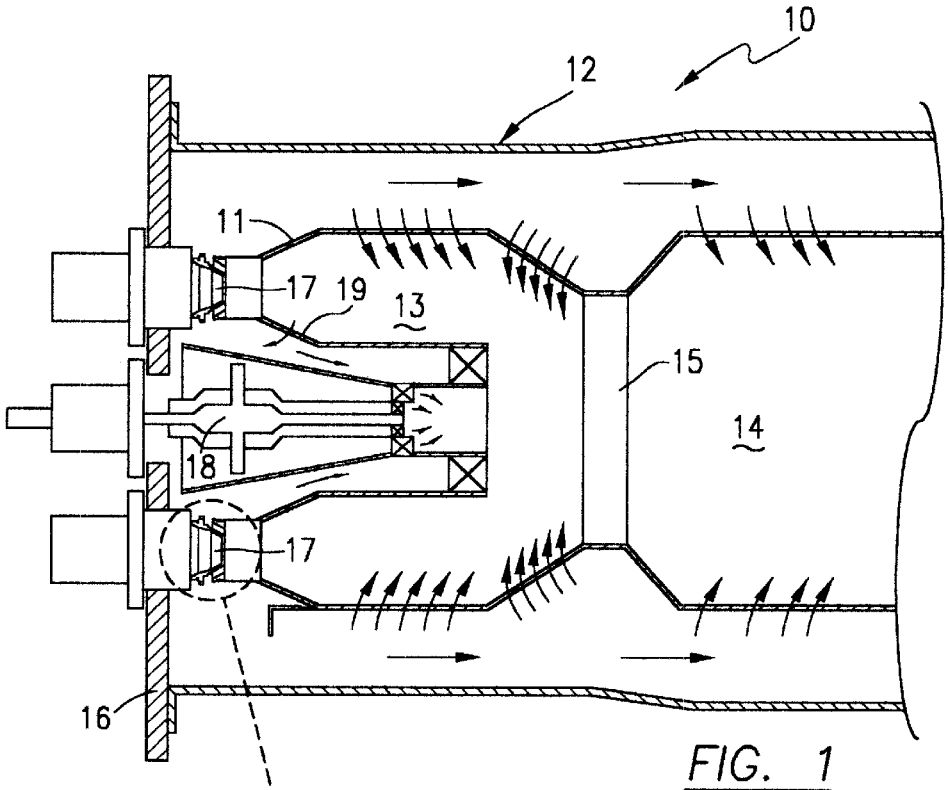
FIG. 1 PRIOR ART
FIG. 1 is a side elevation, in cross section, of a portion of a conventional combustor for a gas turbine.

Referring to FIG. 1, a conventional two stage, dual mode combustor 10 is shown. The combustor includes a combustion liner 11, outer flow sleeve (or heat shield) 12, and a surrounding case (not shown). The combustion liner contains two chambers, one upstream 13 and one downstream 14, separated by the combustor venturi 15. The combustion liner 11 is enclosed within the combustion system by a cover 16, which contains an array of primary fuel nozzles 17 as well as a single, center secondary fuel nozzle 18. Fuel nozzles 17 and 18 are located within combustion liner 11 by liner cap assembly 19. These fuel nozzles work together to produce combustion in either the upstream combustion chamber 13, downstream combustion chamber 14, or both chambers, depending on the desired operating conditions.

Figure 2:
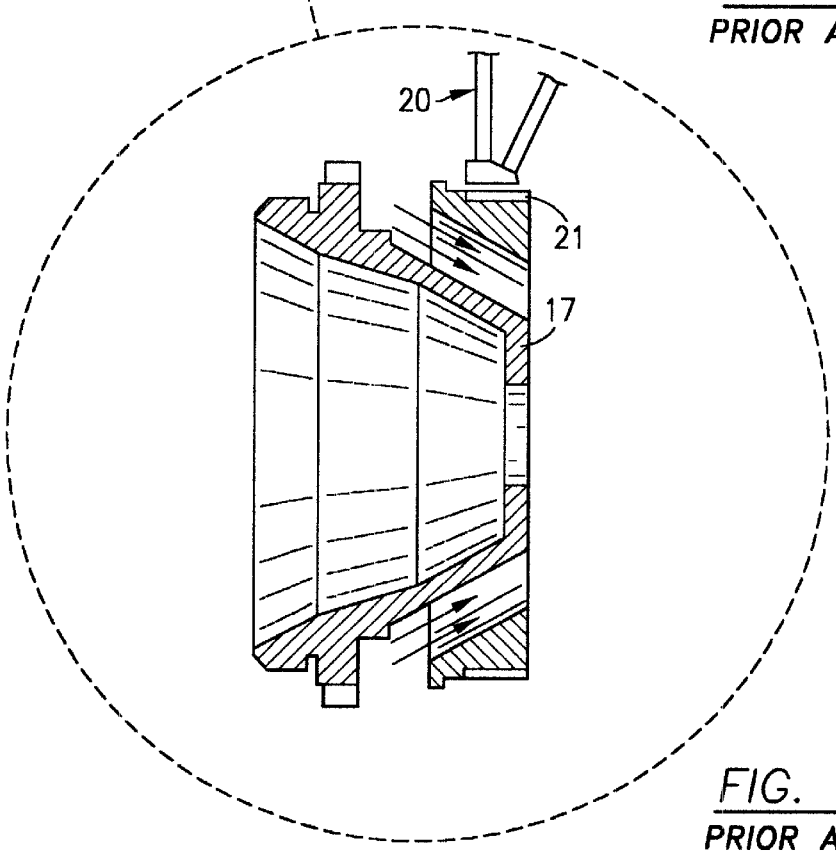
FIG. 2 PRIOR ART
FIG. 2 is an enlarged detail of FIG. 1 and shows a side elevation, in cross section, of a fuel nozzle and combustor cap engagement.

With reference to FIG. 2, an enlarged cross sectional view of a primary fuel nozzle 17 is shown, as was discussed in the related art. Also shown in FIG. 2 is the floating collar 20 of the combustion liner cap assembly 19. Floating collar 20 engages and locates primary fuel nozzle 17 in combustion liner 11 and is slightly larger than the primary fuel nozzle to provide a loose fit in the combustion liner cap (not shown). Given the larger size of the collar and its ability to move freely or float, during engine operation it will tend to contact the fuel nozzle and rub against it. As discussed in the related art, fuel nozzle 17 contains weld build-up 21 and floating collar 20 would wear the weld build-up away as a result of repeated frictional contact between the two parts.

Figure 3:
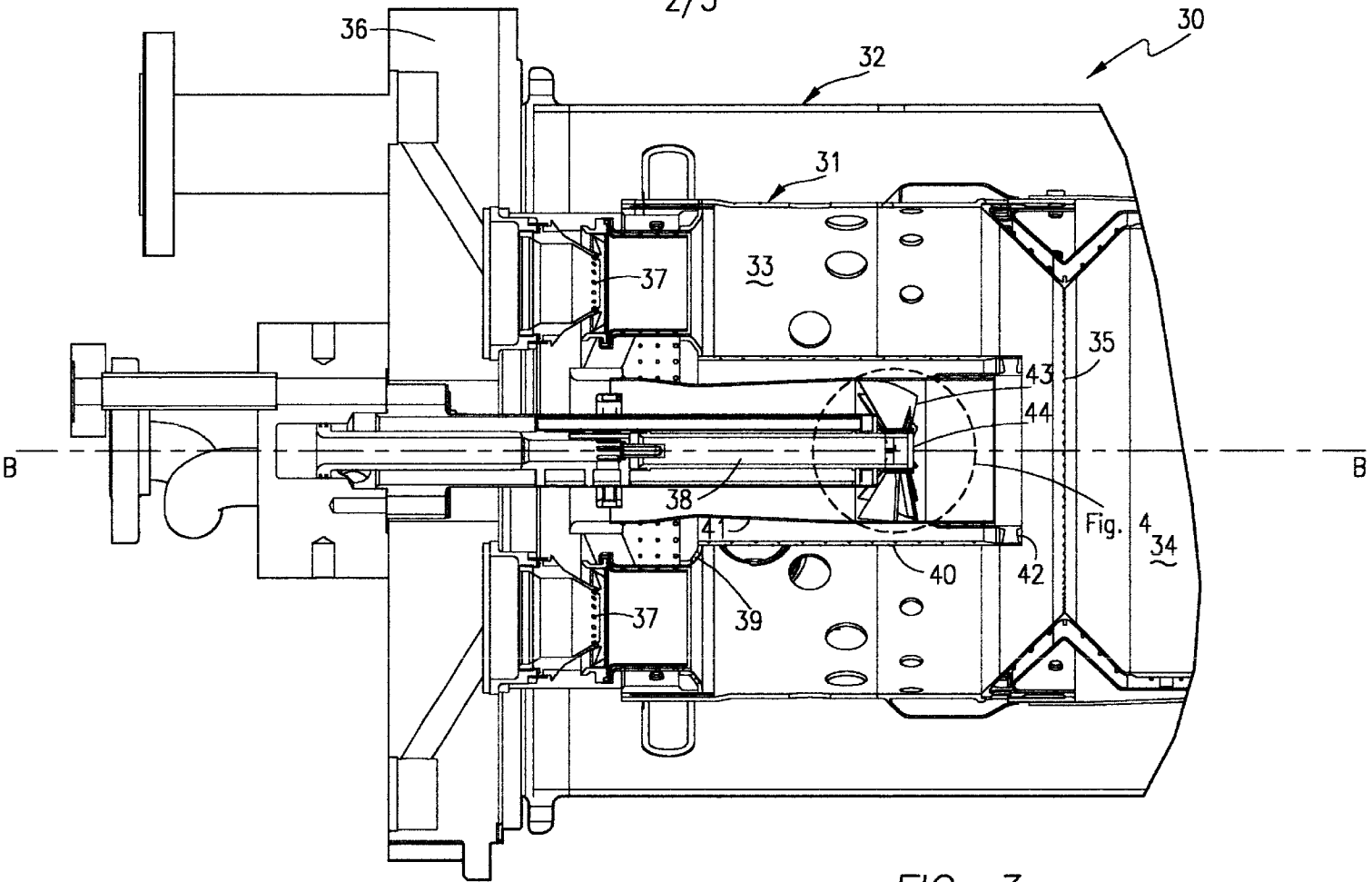
FIG. 3 is a side elevation, in cross section, of a portion of the combustor in which the present invention is applied.
Figure 4:
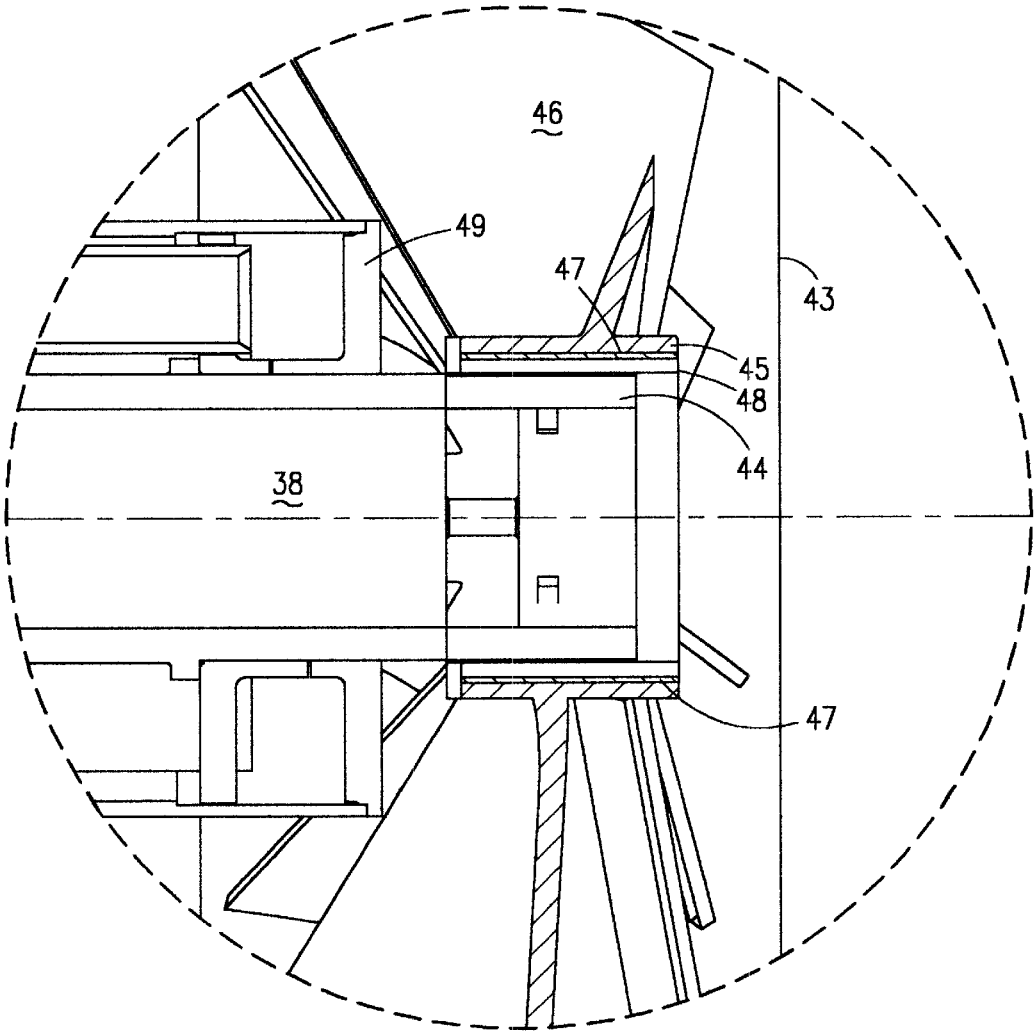
FIG. 4 is an enlarged detail of FIG. 3 which incorporates the details of this invention.

The preferred embodiment is shown in FIGS. 3 and 4. FIG. 3 shows another version of a two stage, dual mode combustion system 30. This system contains a combustion liner 31, flow sleeve (or heat shield) 32, and a surrounding case (not shown). The combustion liner contains two chambers, one upstream 33, and one downstream 34, separated by a venturi 35. The combustion system is enclosed with an end cover 36, which contains an array of primary fuel nozzles 37, as well as a single, central secondary fuel nozzle 38. Similar to other two stage, dual mode combustors, these fuel nozzles work together to produce combustion in either the upstream combustion chamber 33, the downstream combustion chamber 34, or both combustion chambers, depending on the desired operating condition.

Combustion liner 31, shown in FIG. 3, also contains a cap assembly 39, which includes two concentric centerbody tubes 40 and 41, that are co-linear about axis B-B. An air swirler 42 is located at the exit of and between tubes 40 and 41, while a premix swirler 43 is located completely within tube 41. The central secondary fuel nozzle 38 has a tip 44 that engages premix swirler 43 when the secondary fuel nozzle is installed in combustor 30, through end cover 36. It is the engagement area of nozzle tip 44 to premix swirler 43 that is the focus of this invention. This area of engagement and the preferred embodiment of the invention is shown in detail in FIG. 4.

FIG. 4 shows the engagement of secondary fuel nozzle 38, with nozzle tip 44, into premix swirler 43. This is accomplished by having an inner ring 45 located within the vanes 46 of premix swirler 43. The present invention is shown on the engagement surfaces of the premix swirler and secondary fuel nozzle tip as items 47 and 48, respectively. The inner ring 45 of the premix swirler 43 contains a cylindrical insert 47 which is constructed of a hardened material, such as L-605. L-605 is a high temperature cobalt-base superalloy for wear resistance between mating components. The insert 47 is welded in place to inner ring 45 such that it can be removed during combustion overhauls and replaced with a new insert. To complete the interface region, the fuel nozzle tip 44 is coated with a metal spray, such as Stellite 31, that is harder than the insert 47, such that any wear that does occur due to part-to-part contact occurs on the replaceable insert 47. The fuel nozzle tip coating is shown in FIG. 4 as region 48.

When examining this assembly carefully, it becomes evident that wear protection in this region is necessary due to the means in which the central fuel nozzle is mounted to the combustor. The central fuel nozzle assembly 38 is mounted to the end cover 36 and the nozzle tip hangs in a cantilevered position, extending approximately 14 inches into the combustor. Assembly tolerances, manufacturing tolerances, and engine vibrations can combine to result in the fuel nozzle tip 44 contacting and wearing against premix swirler inner ring 45. Typically there is a nominal gap between nozzle tip 44 and inner ring 45 of premix swirler 43. This gap can vary from engine to engine up to 0.025" radially. This gap exists in order to minimize the amount of part-to-part contact. Excessive gaps between nozzle tip 44 and inner ring 45 allows fuel or air, which exits from orifices 49, depending on the mode of operation, to pass through this gap instead of through the premix swirler, thereby reducing the amount of fuel and air mixing prior to combustion. Actual engine-run hardware has shown excessive wear at this interface requiring extensive and costly repairs to each component.

Unlike the prior art, it is more desirable to limit what wear does occur to the premix swirler insert 47 rather than the fuel nozzle tip 44, for a variety of reasons. First, the fuel nozzle is carefully flow tested and fuel orifices 49 are reworked and adjusted to within +/−0.001" of nominal design after final machining or coating. Any wear to the tip area of the nozzle as a result of interaction with the premix swirler could have an undesirable affect on fuel flow to the combustor. Therefore, with the fuel nozzle tip 44 and coating 48 as the harder surface in the relationship, this area requires minimal repair or replacement of coating. Second, insert 47 is welded to the inner ring 45 of premix swirler 43 in such a way that it can be easily removed during standard combustor maintenance, during which the cap assembly 39 is removed from the combustion liner 31 for overhaul and reapplication of its thermal barrier coating. Therefore, no extra processes are required in order to gain access to the premix swirler 43 region. Once the insert is removed, by cutting the welds, no extra machining or operations are required prior to welding a new insert in place. The third reason the present invention is more advantageous over the prior art is with respect to hardware already in service in gas turbines. The most feasible method to practice the prior art and make the premix swirler wear resistant and direct wear to the fuel nozzle tip, would be to make the premix swirler out of a hardened material. This would require extensive overhaul operations to discard portions of the old cap assembly 39, specifically concentric tubes 40 and 41, as well as swirlers 43 and 44. The cost to the user to practice the prior art at this location would be significantly more than the present invention. Therefore, the present invention provides a means to increase the component life of both the premix swirler 43 and secondary fuel nozzle tip 44 at a minimal cost to the user.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A wear reduction means for a gas turbine combustor fuel nozzle tip and corresponding engagement surface comprising:

an elongated fuel nozzle having opposing ends;

one end of said elongated fuel nozzle having a coating;

an engagement surface within a combustion liner; said engagement surface proximate said coating;

an insert manufactured of a hardened material located within said engagement surface wherein the material of said insert has a hardness less than the material of said coating of said fuel nozzle.

2. The gas turbine combustor of claim 1 wherein said fuel nozzle tip and said corresponding engagement surface are manufactured from similar materials.

3. The wear reduction means of claim 1 wherein said coating is Stellite 31.

4. The wear reduction means of claim 3 wherein said coating is applied up to 0.025 inches thick to said fuel nozzle tip.

5. The wear reduction means of claim 1 wherein said insert is manufactured from L-605.

6. The wear reduction means of claim 1 wherein said insert is manufactured from material at least 0.015 inches thick.

* * * * *